US005237546A

United States Patent [19]

Vollert

[11] Patent Number: 5,237,546

[45] Date of Patent: Aug. 17, 1993

[54] TIMEPIECE WITH A ROTATING BEZEL

[75] Inventor: Alfred Vollert, Le Locle, Switzerland

[73] Assignee: Werthanor SA, Le Locle, Switzerland

[21] Appl. No.: 919,962

[22] Filed: Jul. 27, 1992

[30] Foreign Application Priority Data

Jul. 30, 1991 [CH] Switzerland ..... 268/91

[51] Int. Cl.[5] ..... G04B 37/00

[52] U.S. Cl. ..... 368/294

[58] Field of Search ..... 368/294, 296

[56] References Cited

U.S. PATENT DOCUMENTS 4,815,053 3/1989 Dal Busco ..... 368/294

5,122,997 6/1992 Schneider et al. ..... 368/295

FOREIGN PATENT DOCUMENTS 1541847 10/1967 France .

432388 11/1966 Switzerland .

547518 3/1974 Switzerland .

636743 6/1983 Switzerland .

660441 4/1987 Switzerland .

*Primary Examiner*—Vit W. Miska

*Attorney, Agent, or Firm*—Griffin, Butler, Whisenhunt & Kurtossy

[57] ABSTRACT

This watch case includes an assembly (3) capable of being rotatively driven relative to a caseband (8), said assembly including a bezel (1) exhibiting an interior shoulder (20), a crystal (2) and an annular element forming a flange (5). A packing (9) is interposed between the bezel and the caseband. A casing ring (10, 11) is arranged within the caseband so as to receive a movement (7). The ring exhibits an annular rib (21) resting on the bezel shoulder (20) so as to retain said assembly (3) on said caseband (8).

10 Claims, 6 Drawing Sheets

TIMEPIECE WITH A ROTATING BEZEL

The present invention relates to a watch case including caseband, a back cover, a movement housed in the case, a dial surmounting the movement and an assembly capable of being rotatably driven relative to the caseband and to the dial, said assembly including a bezel exhibiting an inner annular shoulder, a crystal fitted to the bezel with the aid of a first packing and an annular element forming a flange, a second packing being interposed between the bezel and the caseband.

BACKGROUND OF THE INVENTION

A watch case generally corresponding to the generic definition which has just been given is described in the patent document CH-A-432 388 (Schmitz Frères). In this construction an interior ring is screwed into the caseband and such ring includes a skirt which rests on a shoulder of the bezel in a manner to maintain such bezel in place on the caseband. The ring is here used only in order to retain the movable assembly on the caseband and has no other functions. In view of this, the casing up of the movement can only take place from below the caseband with, as corollary, a dial the diameter of which is smaller than the overall diameter of the movement. In the case in which the flange of the bezel bears graduations rotating opposite other graduations borne by the fixed dial, such graduations being employed as a slide rule for instance, there is an interest in enlarging the dial beyond the diameter of the movement in order to increase the reading precision and to facilitate the application of the graduations onto the dial and the flange.

Thus, as will be seen in the present invention, if one employs the ring of the cited document not only as a retaining means but further as a casing ring for the movement, it is possible to propose a construction in which the dial is larger than the movement. The ring then fulfils an additional function which is neither described nor suggested in the cited document.

SUMMARY OF THE INVENTION

In order to attain this purpose, the case of the invention is characterized by the fact that it comprises a casing ring arranged within the caseband, first means for securing the movement within the casing ring and second means for locking the ring to the caseband, said ring exhibiting an annular skirt resting on said shoulder for attaching said assembly to said caseband.

The invention will now be explained with the help of the following description given by way of example and with the aid of the drawings which illustrate it.

DESCRIPTION OF THE PREFERRED EMBODIMENTS

Figure 1:
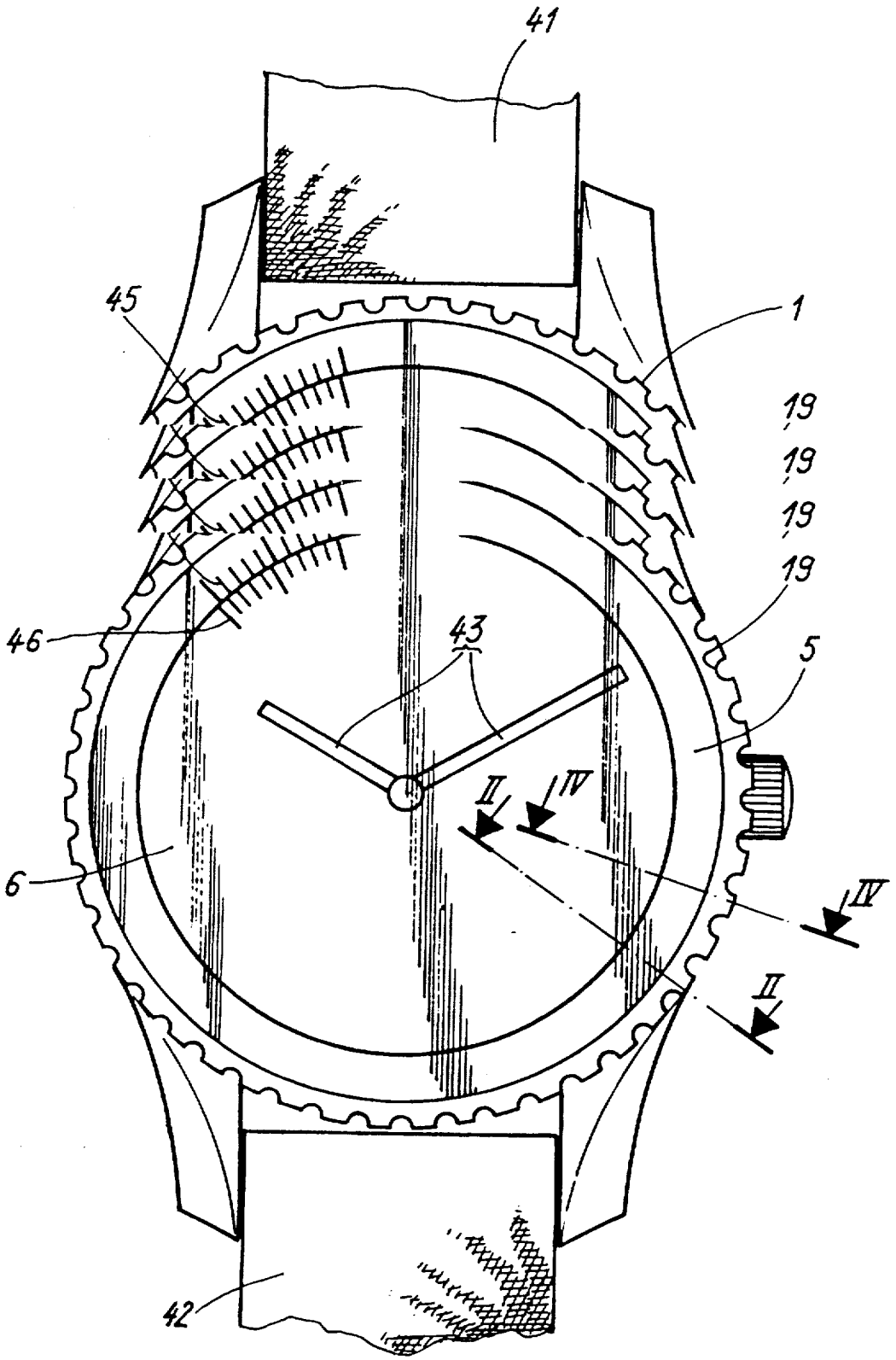
FIG. 1 is a plan view of the watch case in accordance with the invention.

FIG. 1 is a top view of the watch case in accordance with the invention. On the dial 6 are for example assembled hands 43. To the caseband are fitted lugs for attaching the bracelet strands 41 and 42. On this plan view may be distinguished a rotating bezel 1 provided with knurling 19. A flange 5 on which are placed graduations 45 is fixed to the bezel 1. Facing the graduations are found other graduations 46 placed on the dial 6. The graduations 45 and 46 are here only partially represented.

Figure 2:
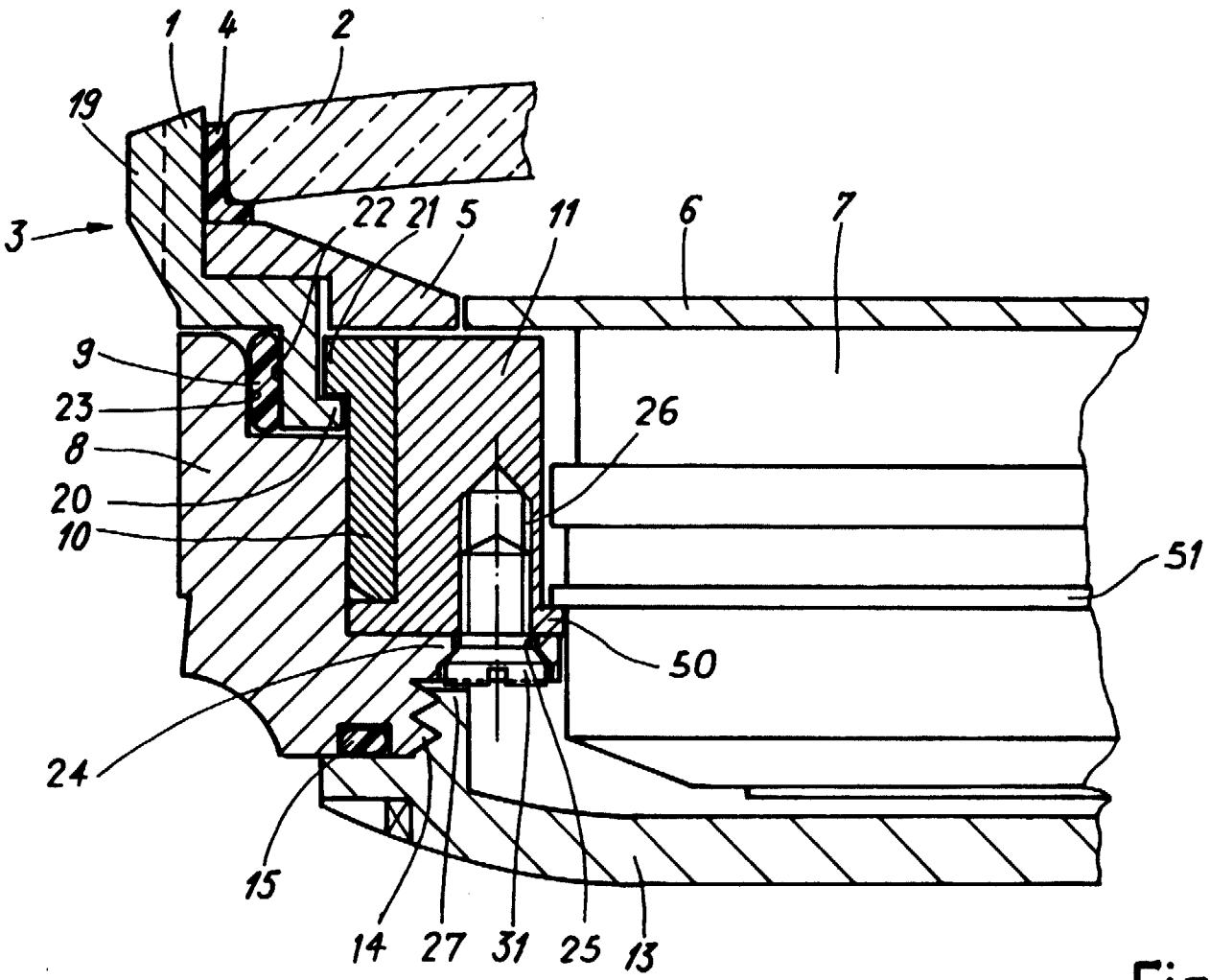
FIG. 2 is a cross-section along line II—II of FIG. 1.
Figure 4:
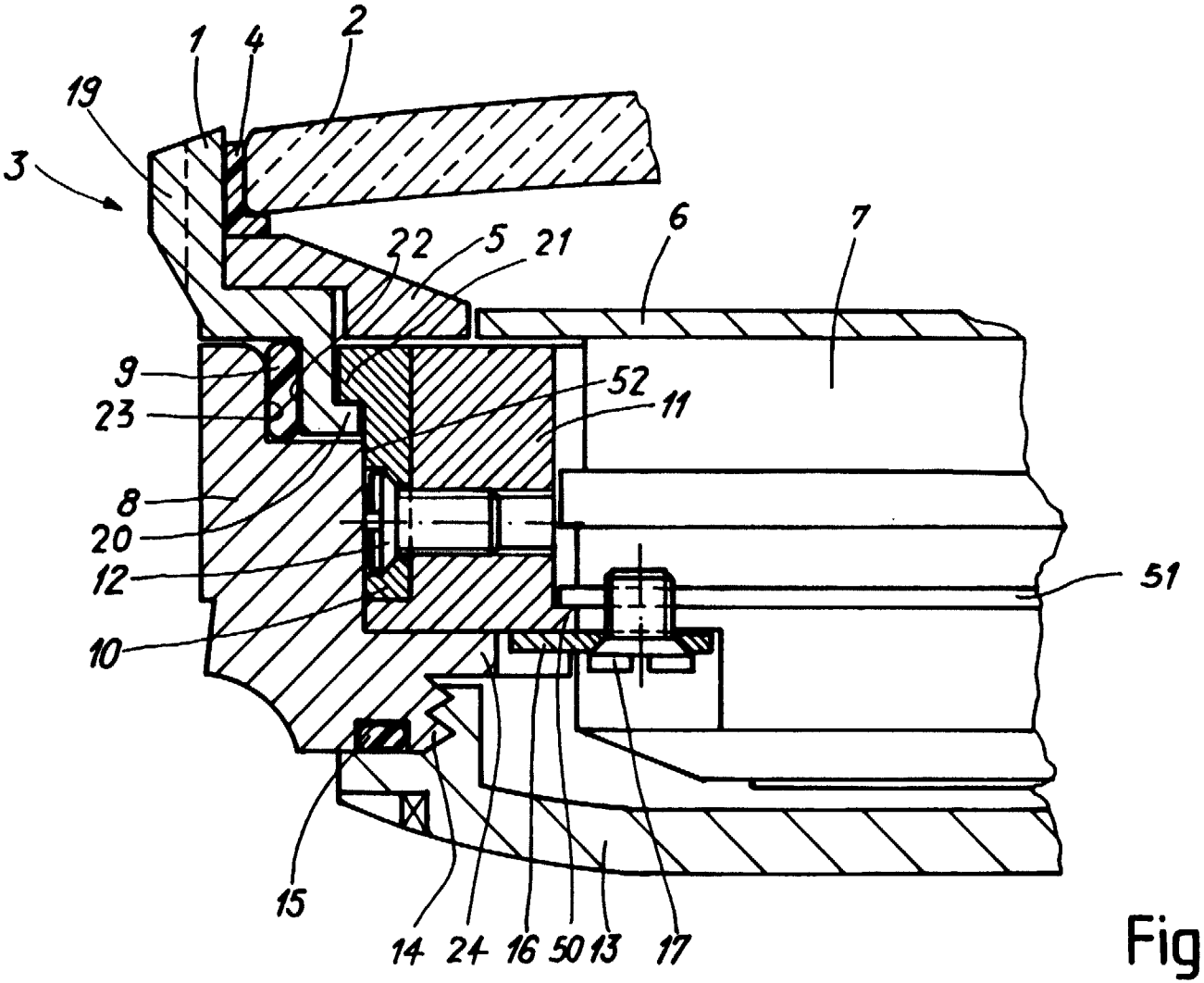
FIG. 4 is a cross-section along line IV-IV of FIG. 1.

The cross-sections of FIGS. 2 and 4, here taken respectively along lines II—II and IV—IV of FIG. 1, show that the case includes a caseband 8, a back cover 13, a movement 7 housed in the case, a dial 6 surmounting the movement 7. An assembly 3 including a bezel 1 presenting an annular interior shoulder 20, a crystal 2 fitted to the bezel through a first packing 4 and an annular element forming a flange 5 may be driven in rotation relative to the caseband and to the dial. Between the bezel and the caseband is squeezed a second packing 9 which assures sealing of the case.

In the example shown in the drawings, packing 9 is arranged between two coaxial cylindrical surfaces, one 22 of which bounds a portion of the bezel and the other 23 bounds a portion of the caseband.

FIGS. 2 and 4 above all show what establishes the particularity of the present invention, namely that the case includes a casing ring 10-11 arranged within the caseband 8, such ring exhibiting annular skirt 21 resting on the shoulder 20 of the bezel 1 for attaching or retaining the rotating assembly 3 onto the caseband 8. Thus, the ring of the cited document here is transformed into a casing ring which serves not only for retention of the bezel, but further for supporting the movement. FIG. 4 also shows that first means are provided in order to secure movement 7 in the ring 10 - 11 such means consisting of clamps 16 and screws 17 in the construction taken here as an example. FIG. 2 also shows that second means 31 are employed for locking ring 10 - 11 to the caseband 8.

FIG. 2 shows that the caseband 8 in its lower portion exhibits a skirt 24 extending towards the center of the case. The casing ring 10-11 bears on such skirt 24. The second means evoked hereinabove are vertically positioned screws 31 traversing bores 25 provided in the skirt 24 and screwed in threads 26 provided in ring 11.

It is here interesting to note that the construction provides a back cover 13 provided with projections 27 which, once the back cover is in place under the caseband 8, prevents screws 31 from coming unscrewed even if such screws are loosened. Here the back cover 13 is screwed at 14 to caseband 8. It could however also be secured thereto by means of a snap.

FIGS. 2 and 4, as also FIG. 5, which will be discussed hereinafter, show a dial 6 the diameter of which is greater than the overall diameter of the movement 7 which is favourable for the reasons evoked in the introduction to this description. In this case, the same figures show that movement 7 is encased from above the casing ring 11, such ring exhibiting a shoulder 50 against which bears a bead 51 of movement 7. In order to permit this dial overhang, FIGS. 2 and 4 show that the casing ring is formed in two parts, namely a first interior part 11 including the shoulder 50 against which the movement 7 is supported, and a second exterior part 10 including the skirt 21. The greatest possible diameter of the dial 6 is limited by the interior diameter of the casing ring 10. It will be observed furthermore that the flange 5 can also overlap dial 6 with the object of rendering invisible the slot which is located between the flange and the dial and also with the purpose of simplifying the construction.

The assembly of the case with the movement which it encloses is accomplished in accordance with the following order. From the top of the bezel 1 taken alone, there is assembled the outer portion 10 of the casing ring until the skirt 21 of the ring comes to bear on shoulder 20 of the bezel. The flange 5 is assembled into the bezel 1 and the packing 4 is placed on the flange. Crystal 2 is forced into packing 4. The assembly 3, intended to rotate in caseband 8 is obtained, such assembly bearing furthermore the outer portion 10 of the casing ring, such portion remaining free to move in rotation on such assembly. The movement 7 is introduced into the interior portion 11 of the casing ring from above until the bead 51 of the movement is brought to abut on shoulder 50 of the ring. The movement 7 is secured on the ring 11 by means of screws 17. The inner portion 11 of the ring with its movement is introduced to the interior of the outer portion 10 of the ring and from below such outer portion. The two portions of the ring are fixed to one another by means which will be discussed hereinafter. A packing 9 is arranged on the cylindrical surface 22 of bezel 1. The assembly thus formed is introduced from above into caseband 8 until the ring 11 is supported against skirt 24 of the caseband. The ring 11 is secured to the caseband by means of screws 31. Finally, the case is closed by means of the screwed-on back cover 13 with the interposition of a packing 15 between back cover and caseband.

The question was raised in the preceding paragraph of the securing of the two portions of the casing ring within one another. One embodiment thereof is shown on FIG. 4 in which it is seen that the outer portion 10 is secured onto the inner portion 11 by means of screws 12. In this construction, it is furthermore arranged that the heads of the screws 12 are at a very slight distance from the internal wall 52 of the caseband 8 when the case is assembled. It will be understood that by this means the screws cannot be lost since as soon as they are loosened, the heads come into contact with the caseband which prevents the screws from coming unscrewed further.

Figure 5:
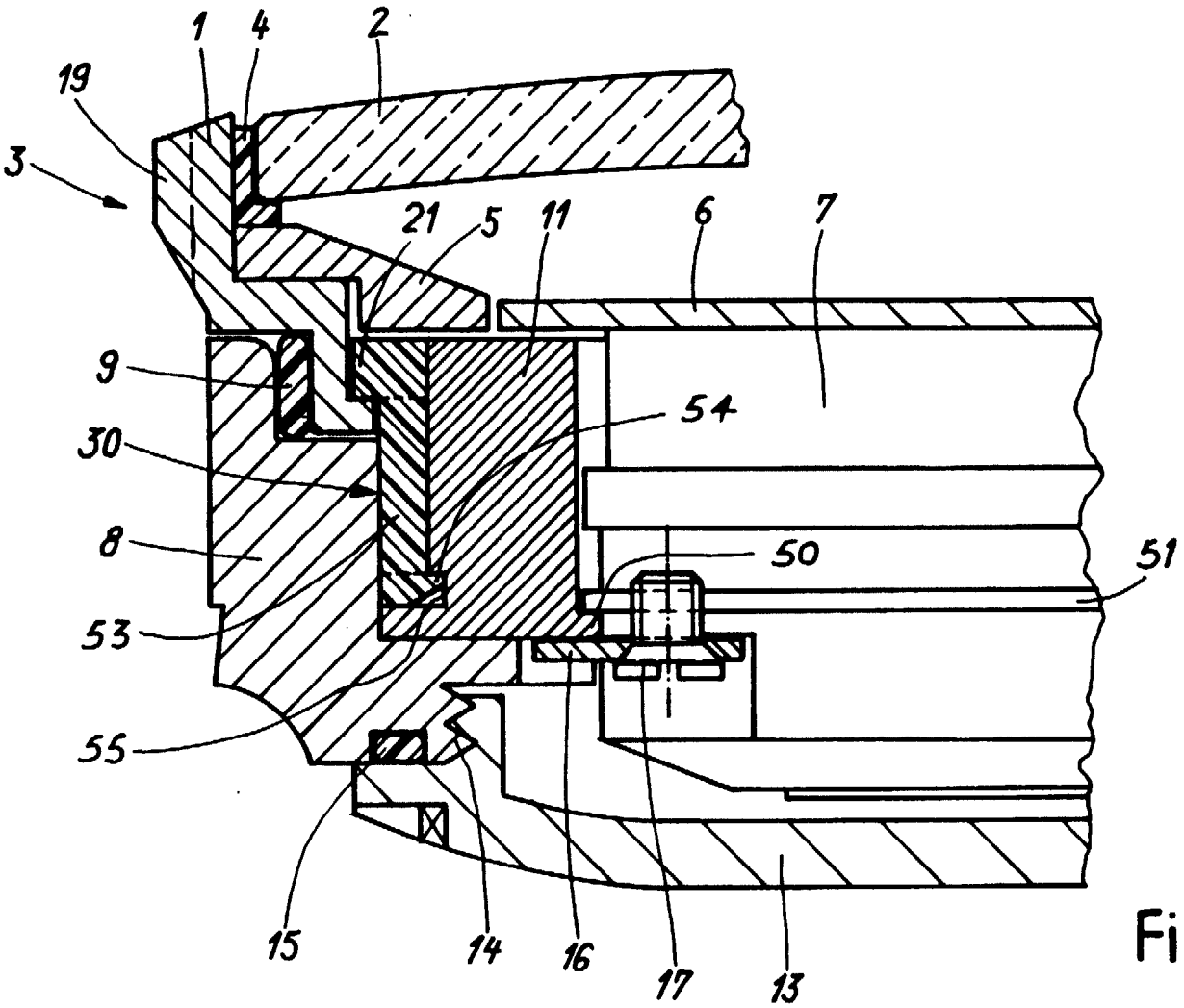
FIG. 5 shows a variant relative to that shown in FIG. 4.

Another method of securing the two portions of the casing ring is shown on FIG. 5. Here the outer portion 30 exhibits elastic zones 53, each provided with a beak 54 which comes into hooking engagement in a notch 55 formed in the inner portion 11. In this embodiment, the outer portion 30 will be advantageously formed from plastic material.

Figure 6:
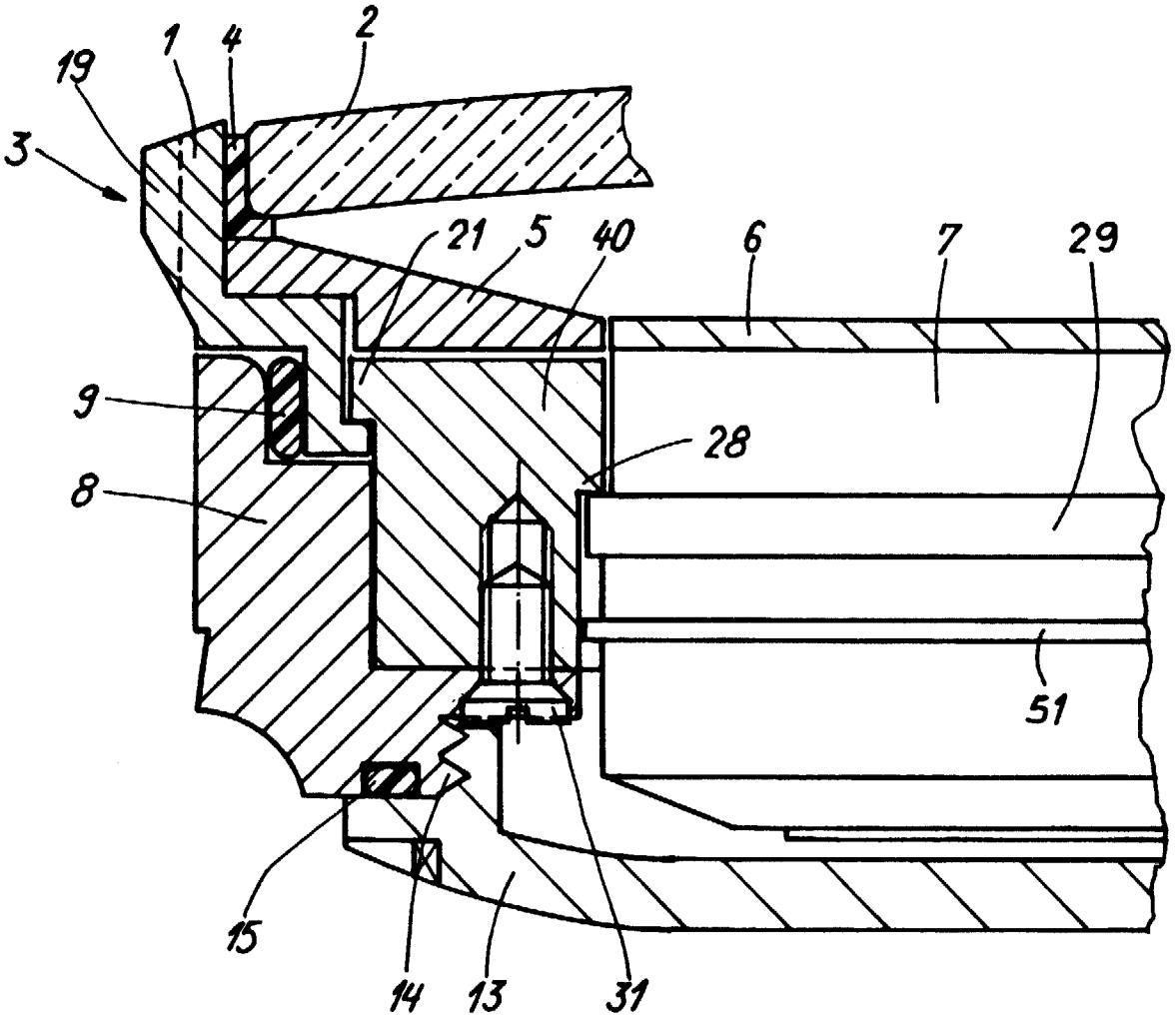
FIG. 6 shows a variant relative to that of FIG. 2.

The present invention also permits, if necessary, to employ a movement with a dial which is smaller or equal in diameter to the diameter of the movement. This embodiment is shown on FIG. 6. In this case, the movement 7 is cased up from below a casing ring 40 which may be formed in a single piece with its skirt 21 and a shoulder 28 against which is supported a bead 29 of the movement.

Figure 3:
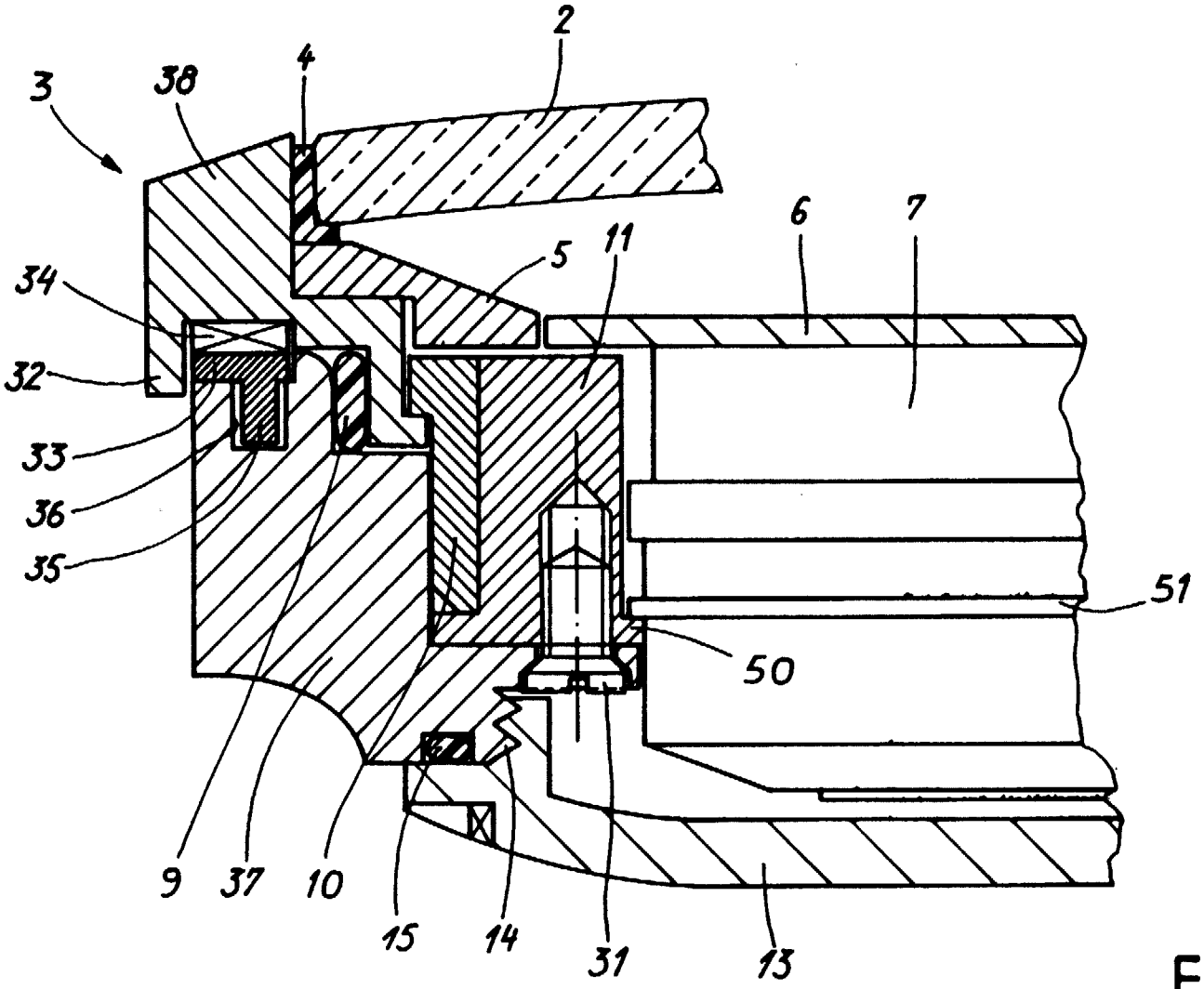
FIG. 3 shows a variant relative to that shown on FIG. 2 in which the watch case is provided with a unidirectional rotating bezel.

FIG. 3 shows an embodiment of the rotating bezel, furthermore in conformity with the description hereinabove, in which is assembled between the rotating assembly 3 and caseband 37 a unidirectional rotation arrangement for said assembly. This arrangement includes a ring 33 in which springs are raised which act on ratchets 34 referred to as a rack and fixed to bezel 38. Such ring 33 is retained and oriented by at least one spur 35 enclosed in a housing 36 formed in caseband 37. A detailed example of this construction is described in the patent document CH-A-631 592. The arrangement is advantageously placed outside the perimeter of the packing 9. An interior position would necessitate a protection of the movement against dust which is given off during rubbing of the spring on the ratchet teeth 34. The arrangement is covered over by the hood 32 which the bezel exhibits. The arrangement is particularly employed for diver's watches.

What I claim is:

1. A watch case including: a caseband; a back cover; a movement housed in the case; a dial surmounting the movement; an assembly capable of being rotatively driven to the caseband and to the dial, said assembly including a bezel exhibiting an inner annular shoulder, a crystal fitted to the bezel with the aid of a first packing, and an annular element forming a flange positioned between said bezel and said crystal; and a second packing being interposed between the bezel and the caseband, said watch case further comprising a casing ring arranged within the caseband; first means for securing the movement within the casing ring; and second means for locking the casing ring to the caseband; said casing ring exhibiting an annular skirt resting on said shoulder for attaching said assembly to said caseband.

2. A watch case as set forth in claim 1 wherein the lower portion of the caseband is provided with a skirt extending towards the center of the case, the casing ring being supported by such skirt, the second means for locking the ring to the caseband consisting of vertically positioned screws passing through bores provided in said skirt and screwed into threads provided in said ring.

3. A watch case as set forth in claim 2 wherein the interior face of the back cover is provided with projections which, once the back cover is in place under the caseband, prevent the screws from unscrewing even if said screws are loosened.

4. A watch case as set forth in claim 1 wherein the diameter of the dial is smaller or equal to the diameter shown by the movement, said movement being cased up from below the casing ring, such latter exhibiting a shoulder against which a bead on said movement is supported.

5. A watch case as set forth in claim 4 wherein the ring with its skirt and its shoulder is formed from a single piece.

6. A watch case as set forth in claim 1 wherein the diameter of the dial is greater than the diameter shown by the movement, such movement being cased up from above the casing ring, such latter exhibiting a shoulder against which a bead on said movement is supported.

7. A watch case as set forth in claim 6 wherein the ring is made up from two concentric portions, namely a first interior portion including the shoulder against which the movement is supported and a second outer portion including said skirt.

8. A watch case as set forth in claim 7 wherein said two concentric portions are secured to one another by means of screws the heads of which are situated at a slight distance from the internal wall exhibited by the caseband when the case is completely assembled.

9. A watch case as set forth in claim 7 wherein said second outer portion exhibits elastic zones each provided with a beak which comes into hooking engagement with a notch formed in said first interior portion.

10. A watch case as set forth in claim 1 further comprising a unidirectional rotation arrangement for the rotatable assembly mounted between said rotatable assembly and the caseband, said arrangement being placed outside the perimeter of said second packing.

* * * * *